US006247608B1

(12) United States Patent
Chang et al.

(10) Patent No.: US 6,247,608 B1
(45) **Date of Patent: *Jun. 19, 2001**

(54) DOUBLE GROOVE BEVERAGE CAN LID

(76) Inventors: Charles Chang; Lucy Chang, both of 55 Westview Ave., Wayne, NJ (US) 07404

( * ) Notice: Subject to any disclaimer, the term of this patent is extended or adjusted under 35 U.S.C. 154(b) by 0 days.

This patent is subject to a terminal disclaimer.

(21) Appl. No.: 09/312,836

(22) Filed: May 17, 1999

Related U.S. Application Data

(63) Continuation-in-part of application No. 09/009,381, filed on Jan. 20, 1998, now abandoned, which is a continuation-in-part of application No. 09/070,056, filed on Apr. 30, 1998, now Pat. No. 5,934,497, which is a continuation of application No. 08/808,108, filed on Feb. 28, 1997, now Pat. No. 5,813,561, and a continuation-in-part of application No. 09/185,468, filed on Nov. 13, 1998, now abandoned.

(51) Int. Cl.[7] ..... B65D 17/34
(52) U.S. Cl. ..... 220/269; 220/270; 220/906
(58) Field of Search ..... 220/269, 906, 220/266, 268; 413/11, 13

(56) References Cited

U.S. PATENT DOCUMENTS 4,266,688 * 5/1981 Reid ..... 220/269
4,333,582 * 6/1982 Bloeck et al. ..... 220/266 X
4,394,927 * 7/1983 Zysset ..... 220/906
4,480,763 * 11/1984 Schneider ..... 220/269
4,998,641 * 3/1991 Willoughby ..... 220/269
5,749,488 * 5/1998 Bagwell et al. ..... 220/269
5,813,561 * 9/1998 Chang et al. ..... 220/269
5,934,497 * 8/1999 Chang et al. ..... 220/906

* cited by examiner

*Primary Examiner*—Nathan J. Newhouse
(74) *Attorney, Agent, or Firm*—Richard A. Joel, Esq

(57) ABSTRACT

A beverage can lid comprises an outer peripheral groove adjacent the outer rim and an inner concentric groove separated therefrom by a dividing rim which is at a predetermined height relative to the outer rim. A center platform is connected to the dividing rim by walls which slope downwardly from said rim. The central pull tab area is approximately the same height as the height of the inner groove and is connected to the inner dividing rim at one end with an upwardly curving surface. The outer groove which may be shallow and permits entry of a crimping tool to mount the lid on a can is also easily cleaned to provide a sanitary can lid. The inner groove may be blocked in the pouring spout area to facilitate cleaning.

13 Claims, 1 Drawing Sheet

FIG. 1
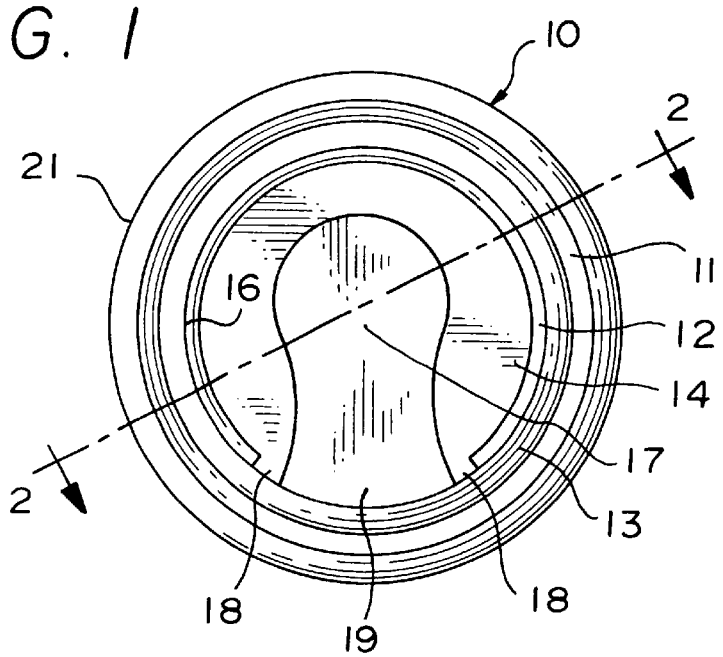
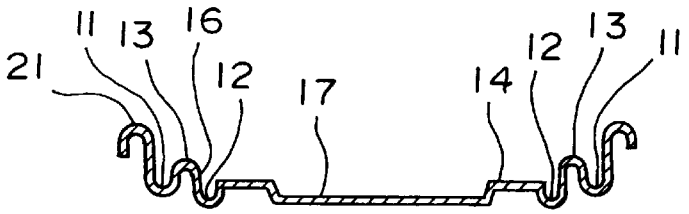
FIG. 2
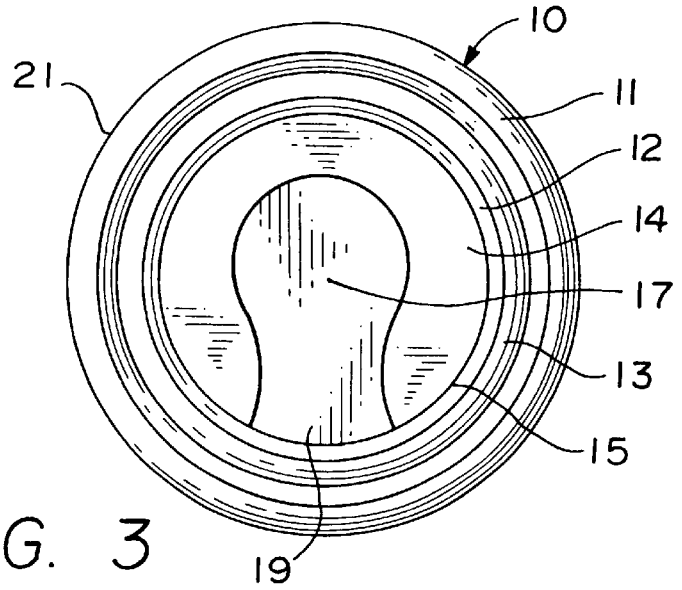
FIG. 3

DOUBLE GROOVE BEVERAGE CAN LID

CROSS-REFERENCE TO RELATED APPLICATIONS

This application is a continuation in part of the following applications: Ser. No. 09/009,381 filed Jan. 20, 1998, now abandoned; Ser. No. 09/070,056 filed Apr. 30, 1998, issued under U.S. Pat. No. 5,934,497 on Aug. 10, 1999 which is continuation of Ser. No. 08/808,108 filed Feb. 28, 1997, issued under 5,813,561; and, Ser. No. 09/185,468 filed Nov. 13, 1998 now abandoned.

STATEMENT REGARDING FEDERALLY SPONSORED RESEARCH OR DEVELOPMENT

Not Applicable

BACKGROUND OF THE INVENTION

1. Field of the Invention

This invention relates to beverage cans for soft drinks, beer, juices and the like, with pull off tabs on the upper lid thereof. In particular, the invention is concerned with a sanitary lid wherein the individual drinking directly from the can does not come in contact with the outer rim groove wherein the dirt and debris is likely to accumulate.

2. Description of the Related Art Including Information Disclosed Under 37 CFR §§1.97–1.98

This invention is designed to provide a sanitary beverage can lid which eliminates the problems associated with can lids of the prior art. The prior art is rather voluminous but it is not believed that the specific double groove invention disclosed herein is anticipated by any of the prior art patents.

In the prior art, U.S. Pat. No. 4,262,815 to Klein, discloses a conical can with an opening tab at the cone apex merely for nesting purposes. This patent discloses a rather complicated conical can end with a different type pull tab. Klein is not concerned with applicant's flat end can. Further, a critical problem with this conical can is the fact that the weight of stacked-up cases will be borne by the conical neck in warehousing and shipping. This requires a very thick and strong material, such as steel, for the conical neck. Also, the design introduces stress to the crimped seal between the neck and the can body whereas in the present invention the cans are stacked on the crimped rim which eliminates the necessity of extra strong lid material and permits the use of recyclable aluminum lids. The present design also proposes a sanitary can lid which can be manufactured with conventional crimping tools U.S. Pat. Nos. 5,108,003 and 5,119,955 to Granofsky disclose the use of a complimentary cover for a beverage can in order to permit sanitary drinking from a can.

U.S. Pat. No. 4,895,270 to Main discloses a sanitary cover for a pop top beverage container comprising an elastic membrane extending over the top and axially along a portion of the side wall of the container.

In another type of container, U.S. Pat. No. 3,946,895 to Pugh discloses a container lid with a tear closure and a straw. Another interesting but different proposal for a sanitary drinking can is disclosed in U.S. Pat. No. 4,114,778 to O'Neal which provides an interiorally attached sanitary drinking spout within the container.

Also of interest are U.S. Pat. Nos. 2,547,059 4,407,425; 4,047,634; 3,300,081; 4,318,493; and, 5,415,313.

The foregoing prior art patents disclose various can lids and means for providing a sanitary can opening for drinking directly from a container. The unique concepts proposed by applicants herein in their double groove design are nowhere seen or suggested in these particular references.

SUMMARY OF THE INVENTION

The present invention relates to beverage cans and particularly to a new and improved double groove sanitary drinking can. The invention comprises a lid which can be affixed to cans with standard crimping tools. An inner groove and an outer concentric groove adjacent the outer rim are separated by an inner dividing rim. A center platform is connected to the dividing rim by walls which slope downwardly from the inner dividing rim and then upwardly from the inner groove.

The central pull tab area is approximately the same height as the height of the inner groove and is connected to the inner dividing rim at one end with an upwardly curving surface. The outer groove, which may be shallow and permits entry of a crimping tool to mount the lid on a can, is also easily cleaned to provide a sanitary can lid.

Accordingly, an object of this invention is to provide a new and improved double groove sanitary can lid.

Another object of this invention is to provide a new and improved double groove sanitary can lid which can be used with existing crimping tools.

A further object of this invention is to provide a new and improved sanitary can lid having a double groove wherein the height of the inner groove is approximately the same as the height of the central pull tab area.

A more specific object of this invention is to provide a new and improved sanitary can lid wherein the outer groove is shallow to permit ease of cleaning and the central platform and pull tab area extend to the outer groove at one end to minimize contact with the groove while drinking.

BRIEF DESCRIPTION OF THE DRAWINGS

The above and other objects and advantages of this invention may be more clearly seen when viewed in conjunction with the accompanying drawings wherein:

FIG. 1 is a is a top view of the double groove lid comprising the invention;

FIG. 2 is a view taken along the line 2—2 of FIG. 1; and,

FIG. 3 is a top view of an alternate embodiment of the invention.

DETAILED DESCRIPTION OF THE INVENTION

This is a continuation-in-part of the following applications: Ser. Nos. 09/009,381, 09/070,056, and 09/185,468.

Referring now to the drawings, the invention comprises a sanitary beverage can lid 10 with double concentric grooves 11 and 12. The outer peripheral groove 11 is separated from the inner groove 12 by a raised inner dividing rim 13. The outer groove 11 is located between outer rim 21 and rim 13. A center platform 14 is connected to the inner dividing rim 13 by walls 16 which slope downwardly from said rim 13. The pull tab area 17 is located centrally on the platform 14 and extends outwardly to the inner dividing rim 13.

The pull tab area 17 is at a height approximately that of the inner groove 12 and is connected to the rim 13 with an upwardly curved surface indicated at 19. The depth of the outer groove 11 can be lower, equal to or slightly higher than the depth of groove 12. The outer groove 11 can be shallow or deep but it still permits the crimping chuck to press into groove 11 during assembly of the lid 10 to a can. Preferably, groove 11 is shallow and may be easily cleaned with one's finger to eliminate any dirt or debris prior to drinking. Groove 12 is interrupted by walls 18 which block liquid from flowing into groove 12. Walls 18 can be lower, equal to or higher than rim 13.

The lid design as proposed herein can be manufactured and assembled to cans with existing crimping tools. The crimping tools which affix the lid 10 to a can may be used in connection with the double groove design. The lid 10 is affixed to the can body as the crimping tool engages groove 11.

FIG. 2 discloses a cross-sectional view taken along the line 2—2 in FIG. 1. The drawing illustrates quite clearly that an individual is able to drink directly from the pull tab area 17 without contacting a debris laden groove 11. In drinking, one would place their lips against the raised rim 13 while for added measure the groove 11 may be easily cleaned in the vicinity of the pull tab area 17. The mounting of lid 10 on the can may be accomplished with existing tools while the advantages of a sanitary can lid are achieved by the double groove arrangement.

FIG. 3 discloses an alternate embodiment of the invention wherein the inner groove 12 extends completely around the lid 10. The upwardly curved surface 19 connects the rim 13 to the pull tab area 17 and comprises the drinking spout for the can which may be readily cleaned.

While the invention has been explained by a detailed description of certain specific embodiments, it is understood that various modifications and substitutions can be made in any of them within the scope of the appended claims which are intended also to include equivalents of such embodiments.

What is claimed, is:

1. A flat end sanitary drinking container comprising:

a main body portion having a base and a hollow cylindrical wall portion extending outwardly therefrom at one end and an outer rim formed at the other end of said cylindrical portion;

a lid having an outer edge mounted to the outer rim and extending over the hollow cylindrical wall portion, an outer recessed groove extending circumferentially adjacent the outer rim, an inner rim extending upwardly from the outer groove, a substantially concentric inner groove adjacent the inner rim, a central platform extending upwardly from the inner groove and having a pull tab area and frangible opening positioned thereon, a pull tab mounted on the central platform adjacent the frangible opening and extending to the inner rim with an upwardly curved surface to permit drinking directly from the opening after the pull tab is actuated to break the frangible opening and facilitate cleaning of the central platform.

2. A flat end sanitary drinking container in accordance with claim 1 wherein:

the pull tab area is at a similar height as the height of the inner groove.

3. A flat end sanitary drinking container comprising:

a main body portion having a base and a hollow cylindrical wall portion extending outwardly therefrom at one end and an outer rim formed at the other end of said cylindrical portion;

a lid having an outer edge mounted to the outer rim and extending over the hollow cylindrical wall portion, an outer recessed groove extending circumferentially adjacent the outer rim, an inner rim extending upwardly from the outer groove, a substantially concentric inner groove adjacent the inner rim, a central platform extending upwardly from the inner groove and having a pull tab area, an upwardly curved surface connecting the pull tab area to the inner rim positioned at a height similar to the height of the inner groove and a frangible opening positioned thereon, a pull tab mounted on the central platform adjacent the frangible opening and extending to the inner rim with an upwardly curve surface to permit drinking directly from the opening after the pull tab is actuated to break the frangible opening and facilitate clearing of the central platform.

4. A flat end sanitary drinking container in accordance with claim 3 wherein:

the outer groove may be lower, equal to or higher than the inner groove.

5. A flat end sanitary drinking container in accordance with claim 3 wherein:

the outer groove may be a shallow groove.

6. A flat end sanitary drinking container in accordance with claim 3 wherein:

the inner rim is at a height lower, equal to or higher than the height of the outer rim.

7. A flat end sanitary drinking container comprising:

a main body portion having a base and a hollow cylindrical wall portion extending outwardly therefrom at one end and an outer rim formed at the other end of said cylindrical portion;

a lid having an outer edge mounted to the outer rim and extending over the hollow cylindrical wall portion, an outer recessed groove extending circumferentially adjacent the outer rim, an inner rim extending upwardly from the outer groove, a substantially concentric inner groove adjacent the inner rim, a central platform extending upwardly from the inner groove and having a pull tab area and a frangible opening positioned thereon, a pull tab mounted on the central platform adjacent the frangible opening and extending to the inner rim with an upwardly curved surface to permit drinking directly from the frangible opening after the pull tab is actuated to break the frangible opening and facilitate cleaning of the central platform; and, a blocking wall on each side of the pull-tab area wherein the concentric inner groove is interrupted by said blocking walls near the pull-tab area.

8. A flat end sanitary drinking container in accordance with claim 7 wherein:

the pull tab area is at a similar height as the height of the inner groove.

9. A flat end sanitary drinking container comprising:

a main body portion having a base and a hollow cylindrical wall portion extending outwardly therefrom at one end and an outer rim formed at the other end of said cylindrical portion;

a lid having an outer edge mounted to the outer rim and extending over the hollow cylindrical wall portion, an outer recessed groove extending circumferentially adjacent the outer rim, an inner rim extending upwardly from the outer groove, a substantially concentric inner groove adjacent the inner rim, a central platform extending upwardly from the inner groove, and having a pull tab area positioned at a height similar to the height of the inner groove and a frangible opening positioned thereon, a pull tab mounted on the central platform adjacent the frangible opening and extending to the inner rim, an upwardly curved surface connecting the pull tab area to the inner rim to permit drinking directly from the frangible opening after the pull tab is actuated to break the frangible opening and to facilitate cleaning of the said area; and, a blocking wall on each side of the pull-tab area wherein the concentric inner groove is interrupted by said blocking walls near the pull-tab area.

10. A flat end sanitary drinking container in accordance with claim 9 wherein:

the outer groove may be lower, equal to or higher than the inner groove.

11. A flat end sanitary drinking container in accordance with claim 9 wherein:

the outer groove may be a shallow groove.

12. A flat end sanitary drinking container in accordance with claim 9 wherein:

the inner rim is at a height lower, equal to or higher than the height of the outer rim.

13. A flat end sanitary drinking container in accordance with claim 9 wherein:

the two blocking walls are at a height lower, equal to or higher than the height of the inner rim.

* * * * *